US005241765A

United States Patent [19]

Jones et al.

[11] Patent Number: 5,241,765

[45] Date of Patent: Sep. 7, 1993

[54] LOCK ASSEMBLY FOR WEARABLE STRUCTURE

[75] Inventors: Larren F. Jones, Aloha; Emory D. Hungerford, Milwaukie; Frederick C. Goeth, West Linn, all of Oreg.

[73] Assignee: ESCO Corporation, Portland, Oreg.

[21] Appl. No.: 837,135

[22] Filed: Feb. 18, 1992

Related U.S. Application Data

[63] Continuation-in-part of Ser. No. 642,390, Jan. 17, 1991, Pat. No. 5,088,214.

[51] Int. Cl.[5] ..... E02F 9/28

[52] U.S. Cl. ..... 37/398; 172/772; 37/451

[58] Field of Search ..... 37/135, 141 R, 142 A, 37/141 T, 142 R; 172/772.5, 772, 713; 299/91, 92

[56] References Cited

U.S. PATENT DOCUMENTS

| | | | |
|---|---|---|---|
| Re. 33,454 | 11/1990 | Potter | 37/135 |
| 4,335,532 | 6/1982 | Hahn et al. | 37/142 A |
| 4,716,666 | 1/1988 | Potter | 37/135 |
| 4,716,667 | 1/1988 | Martin | 37/142 A |
| 4,748,754 | 6/1988 | Schwappach | 37/142 A |
| 4,995,176 | 2/1991 | Briscoe et al. | 37/135 |
| 5,005,304 | 4/1991 | Briscoe et al. | 37/135 |
| 5,088,214 | 2/1992 | Jones | 37/142 A |

*Primary Examiner*—Dennis L. Taylor
*Assistant Examiner*—Spencer Warnick
*Attorney, Agent, or Firm*—Banner, Birch, McKie & Beckett

[57] ABSTRACT

A lock assembly for a surface subject to abrasive wear including a base element and a wear element coupled either by conforming T-shaped elements or dovetails and which includes a lock resiliently urged against an integral keeper in the base or wear element.

30 Claims, 5 Drawing Sheets

FIG. 12
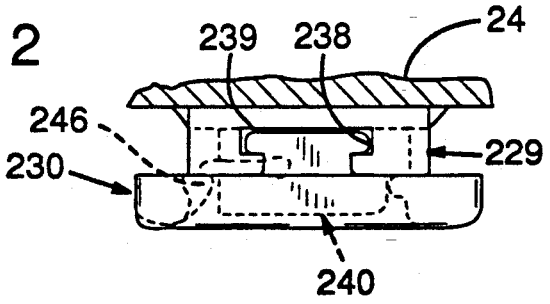
FIG. 13
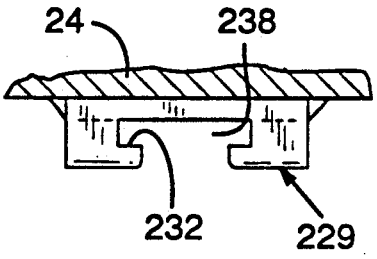
FIG. 14
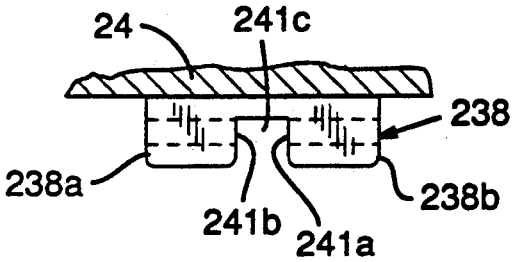
FIG. 15
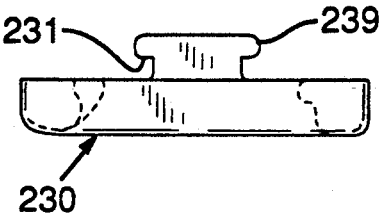
FIG. 16
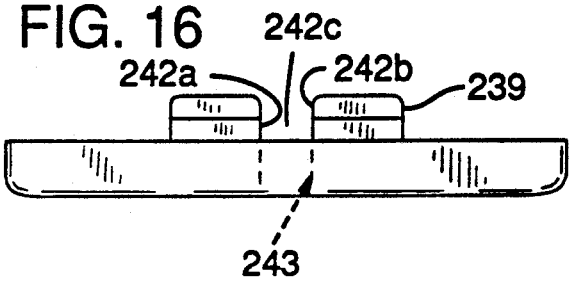
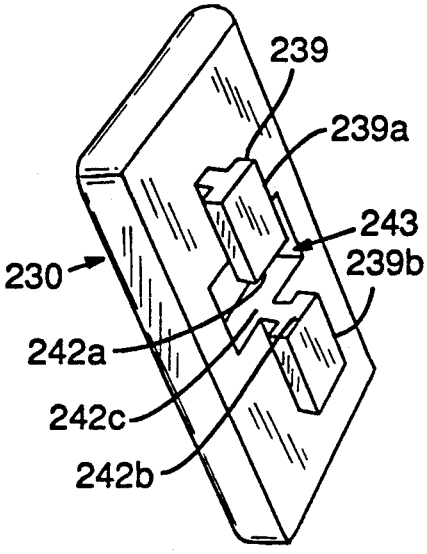
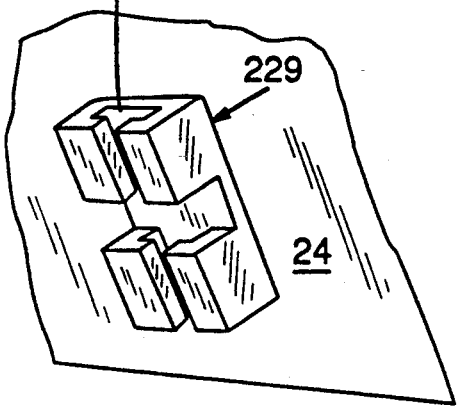
FIG. 17

LOCK ASSEMBLY FOR WEARABLE STRUCTURE

This application is a continuation-in-part of co-pending U.S. application Ser. No. 07/642,390 filed Jan. 17, 1991, now U.S. Pat. No. 5,088,214.

BACKGROUND AND SUMMARY OF INVENTION

This invention relates to a lock assembly for a wearable structure and, more particularly, to a replaceable assembly consisting of a base part and a wear part for protecting a face of a structure engageable with abrasive material. The face so protected is usually flat, i.e., planar or slightly arcuate, as contrasted to the lip or wing protected by the wear part in the above-identified application.

The invention finds utility in connection, for example, with excavating equipment, ore chutes used in mining and other structures subject to abrasive wear. The continuing problem is to provide a part that engages the abrasive material which is securely locked in place during operation yet which is easily replaced when worn. The locks of the prior art often employed resilient keepers or plugs engageable with a pin and imposition of shock loads in combination with abrasion resulted in lock deterioration. Other locking procedures made replacement more difficult as did the welded stops of co-owned patent RE 33,454.

According to the invention, disadvantages of the prior art locks have been overcome through the provision of a relatively elongated wear part having first and second generally planar longitudinally extending surfaces which extend from one end of the wear part to the other. In this aspect, the instant invention differs from that of the above mentioned application where the wear part had a generally J or C shape to wrap around the lip or wing of an excavator, for example.

One of the wear part surfaces herein faces the abrasive material and the other has coupling means such as a tongue or groove for engaging a complementary shape on the base part. The base part is connected to the generally continuous face of the structure to be protected, continuous such as planar but also including slightly arcuate as is found at the rear of a dragline bucket.

In one advantageous embodiment, the inventive lock finds effective application to wearable parts such as wear runners for buckets and chute liners using coupling means such as the dovetails seen in co-owned U.S. Pat. Nos. 33,454 and 5,005,304. The coupling means not only can include sloping surfaces (as in dovetails) but can also employ T-shapes as shown and described in the above-mentioned application. In the latter instance, there are transversely extending, spaced apart walls which are parallel to the generally planar face of the structure to be protected. Thus, in either case, there are transversely spaced longitudinally extending coupling surfaces which prevent movement of the wear part away from the base part.

Each of the tongue and groove is equipped with at least one transverse wall, with these walls being spaced apart and an essentially non-compressible lock mounted between them. The lock is equipped with a laterally extending latch which cooperates with keeper means on either part for maintaining the lock in place. The wear part is equipped with an opening for the insertion of the lock.

BRIEF DESCRIPTION OF DRAWING

The invention is described in conjunction with several illustrative embodiments, in the accompanying drawing, in which—

FIG. 12 is an end elevational view of yet another embodiment of the invention and wherein the generally T-shaped tongue and groove means are reversed from their locations in the embodiment of FIGS. 9–11, i.e., the wear part being equipped with a tongue in this embodiment as compared to the T-shaped groove as seen in FIG. 9, particularly;

FIG. 13 is an end elevational view of the base part of the embodiment of FIG. 12;

FIG. 14 is a side elevational view of the base part of FIGS. 12 and 13;

FIG. 15 is an end elevational view of the wear part of FIG. 12;

FIG. 16 is a side elevational view of the wear part as seen in FIGS. 12 and 15;

FIG. 17 is an exploded perspective view of the embodiment seen in FIG. 12;

DETAILED DESCRIPTION

Figure 1:
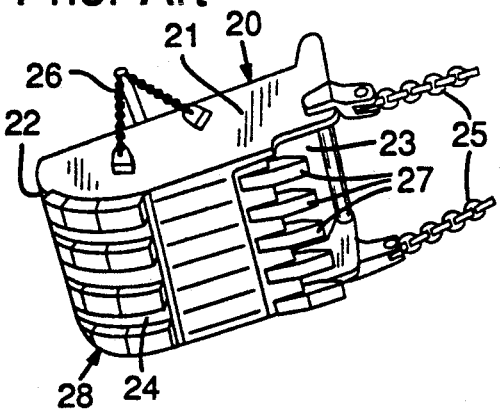
FIG. 1 Prior Art
FIG. 1 is a fragmentary perspective view of a dragline bucket and equipped with prior art runners as seen in U.S. Pat. No. 33,454.

In the illustration given and with reference first to FIG. 1 which is entitled PRIOR ART, the numeral 20 designates generally a dragline bucket having a pair of opposed sidewalls 21, a rear wall 22 and an open front 23. The rear wall merges into a bottom wall 24 which terminates in the open front 23. Drag chains as at 25 are connected to the forward ends of the side walls 21 and hoist chains 26 are connected to an intermediate part of the sidewalls 21.

The forward edge or lip of the bottom wall 24 is equipped with a plurality of forwardly projecting excavating teeth 27. The foregoing construction is generally conventional and is set down for explaining the environment of the invention.

The numeral 28 designates generally a longitudinally extending runner of which a plurality are provided in transversely spaced relation on the bottom wall 24 of the bucket 20.

Each runner assembly includes a plurality of base elements which are welded to the underside of the bucket in serial or longitudinally aligned relation and for each base element a runner element or wear part was provided. This prior art discussion is set down to show an advantageous environment or application of the instant invention. It will be appreciated that the invention can be used to advantage in protecting other surfaces subject to abrasive wear such as ore chute liners.

FIRST EMBODIMENT (FIGS. 2-8)

Figure 2:
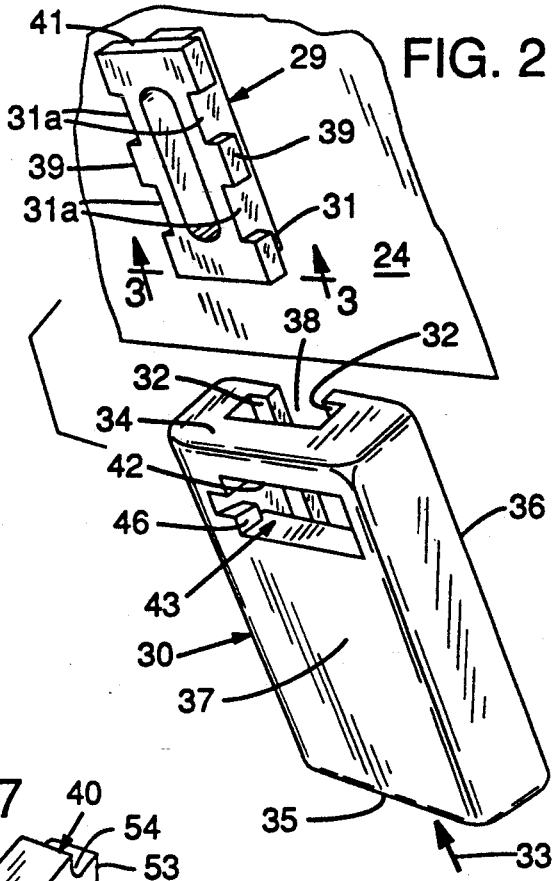
FIG. 2 is an exploded perspective view of the base element and wear part according to a first embodiment of the invention.

Referring first to FIG. 2, the numeral 29 designates generally a base part of the lock assembly of the invention and which cooperates with the runner element or wear part generally designated 3 in protecting the surface 24 from abrasion.

Figure 3:
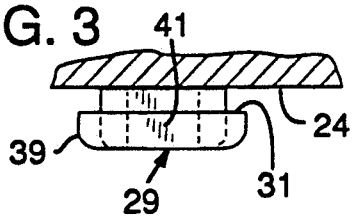
FIG. 3 is a partial sectional view of the base element such as would be seen along the sight line 3—3 applied to FIG. 2.
Figure 5:
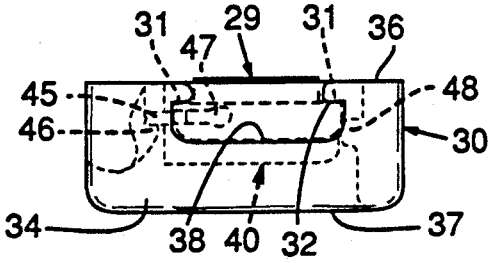
FIG. 5 is a fragmentary end elevational view of the assembled base element and wear part of FIG. 2.

The parts 29, 30 are coupled together by means of a T-shaped connection which can be readily appreciated from a consideration of FIGS. 3 and 5. For this purpose, the base part 29 is equipped with horizontal walls 31 and the wear part or runner element 30 is equipped with a correspondingly shaped opening which provides walls 32.

As used herein, the term "longitudinal" is used in the sense of the movement of the part 30 when being coupled to the part 29. In some instances, the dimension of a particular part in the "longitudinal" direction may be smaller than in the direction perpendicular to assembling movement, i.e., the transverse direction. The longitudinal direction is illustrated in FIG. 2 and relative to the wear part 30 by the arrow 33.

In this example the wear part 30 happens to be relatively elongated (in the longitudinal direction) and has a first end 34 and a second end 35.

This relatively elongated wear part 30 can be considered to have first and second outer surfaces. The first surface is designated 36 and is seen to be that surface which is adjacent the wearable face provided by the bottom 24 of the bucket 20. The second surface 37 of the wear part 30 extends generally parallel to the first surface 36 and is remote from the bottom 24. Further, the first surface 36 is generally continuous (see FIG. 5) and extends generally from the first end 34 to the second end 35 of the wear part 30. Likewise, base part 29 includes a first surface adjacent the wearable face and a second surface remote therefrom.

Figure 6:
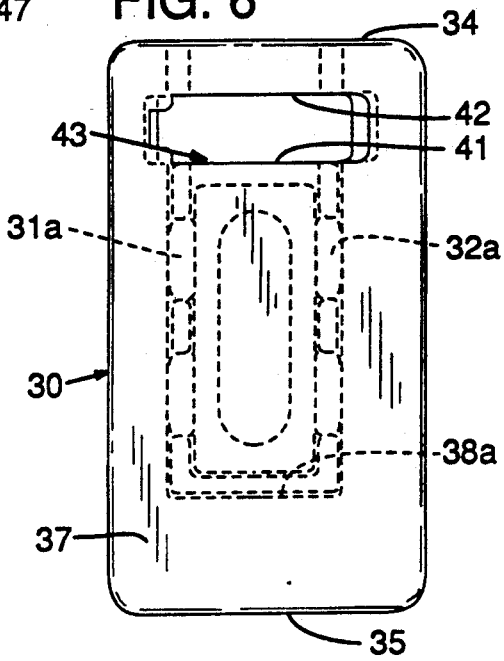
FIG. 6 is a plan view of the assembly of FIG. 5.

Referring to FIG. 2, the wear part 30 can be considered to have longitudinally extending groove means 38 in the first surface 36 engaging the tongue means 39 of the base part 29. Thus, the groove is partly defined by or provides the longitudinally extending, transversely spaced apart walls 32 which engage the longitudinally extending, transversely spaced apart walls 31 in the base part 29—so as to releasably couple the base part and wear part together. In this embodiment, the groove means 38 terminate a spaced distance from the end 34 as at **38*a* (see FIG. 6). As will be brought out hereinafter, the groove means 38 can extend the entire length of the wear part 30 depending upon the application and use factors. The groove means 38 does provide the coacting bearing surfaces 32 for coupling the wear part 30 to the base part 29**.

Figure 4:
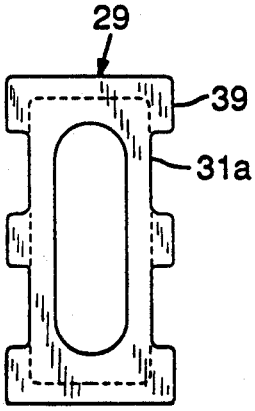
FIG. 4 is a plan view of the base element of FIG. 3.

In the broadest aspect of the invention, the longitudinally extending, transversely spaced apart coupling walls 31, 32 only require mating engagement to prevent the parts from moving apart in a direction perpendicular to the wearable face 24. For example, this is advantageously achieved by the horizontal walls 31, 32 of FIG. 5 which define, in effect, a T-shape; whereas in another embodiment (FIGS. 18-22) the walls are arranged in dovetail fashion. Depending upon the application, the coupling walls may be all parallel or, alternatively, convergent and, further may be continuous or interrupted—see FIG. 4 as at **31*a*. The notches 31*a* (and corresponding notches 32*a* in the wear part—see FIG. 6**) permit coupling or assembly with limited relative longitudinal movement between the parts.

As explained in U.S. Pat. No. 33,454 in regard to convergent dovetail surfaces, the notches **31*a*, 32*a* permit the wear part to be inserted over the base part and moved only a small longitudinal distance until each of wall portions 31 overlay a corresponding portion of wall 32**. This construction thereby provides a substantial length of engagement between the two walls without having to feed the wear part longitudinally over the entire length of the base part. cl LOCK OF EMBODIMENT OF FIGS. 2-8

A lock generally designated 40 (see FIGS. 5 and 7) is provided which utilizes certain of the basic teachings of the above mentioned co-pending U.S. application Ser. No. 07/642,390. Advantageously, the lock is generally block-shaped, viz., a generally rectangular solid, and operates to hold the parts 29, 30 together by being in a compressive mode. This is achieved by virtue of having a transverse wall 41 provided on the base part 29 (compare FIGS. 2 and 6) and a further transverse wall as at 42 in an opening generally designated 43 in the wear part 30.

The opening 43 extends from the surface 37 to the groove means 38 so as to compressibly accommodate the block-like lock 40 between the two transverse walls 41, 42.

Figure 7:
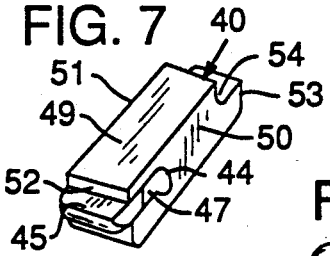
FIG. 7 is a perspective view of the lock employed in the embodiment of FIGS. 2–6.

The lock 40 employed herein is seen in perspective view in FIG. 7. This is the lock that is described in greater detail in the above-mentioned co-pending application and reference may be had thereto for additional details of construction not set forth herein. In addition to the block shape of lock 40, there is provided therein a slot 44 which carries a resilient latch 45. In FIG. 5, the latch 45 is seen to engage keeper means 46 provided on the wear member 30 (see also FIG. 2). The resiliency is provided by a rubber plug 47 (FIGS. 5 and 7) which is bonded to the metal end portion of the latch 45. As before, the wear part 30 has an arcuate protrusion 48 (see FIG. 5) about which the lock 40 pivots.

If the assembly of FIG. 5 is used in the FIG. 1 application with the end 35 positioned forwardly, the function is similar to that described in the above-described mentioned application. The lock is compressively stressed during negative thrust, i.e., back slap as where the bucket is moved rearwardly. Positive thrust—as in normal digging—is resisted by the wall 38*a* of the wear part at the closed end 35 (see FIG. 6).

Figure 8:
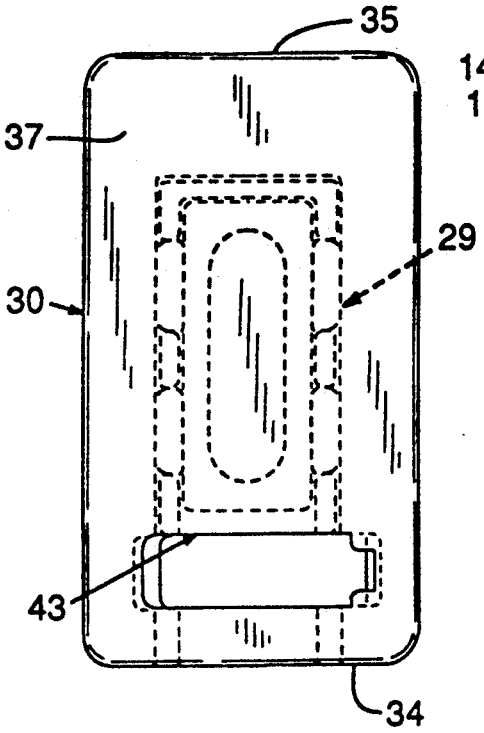
FIG. 8 is a view similar to FIG. 6 but showing the wear part reversed in position on the base part.

When the wear part 30 is reversely mounted on the base part 29 as seen in FIG. 8, the lock is compressively stressed during positive thrust. Further, in some instances, it is advantageous to have the groove means 38 extend the length of the wear part and, in such a case, the lock 40 would also be subjected to compression during positive thrust.

Still further, the end-to-end assembly of base and wear parts can extend transversely, viz., across the width of the bucket. It should be appreciated that often bucket operators want to cover the entire outer bottom wall with replaceable wear parts. If the integral wall has a portion exposed, repair can be costly, particularly in terms of down time.

EMBODIMENT OF FIGS. 9–11

Figure 9:
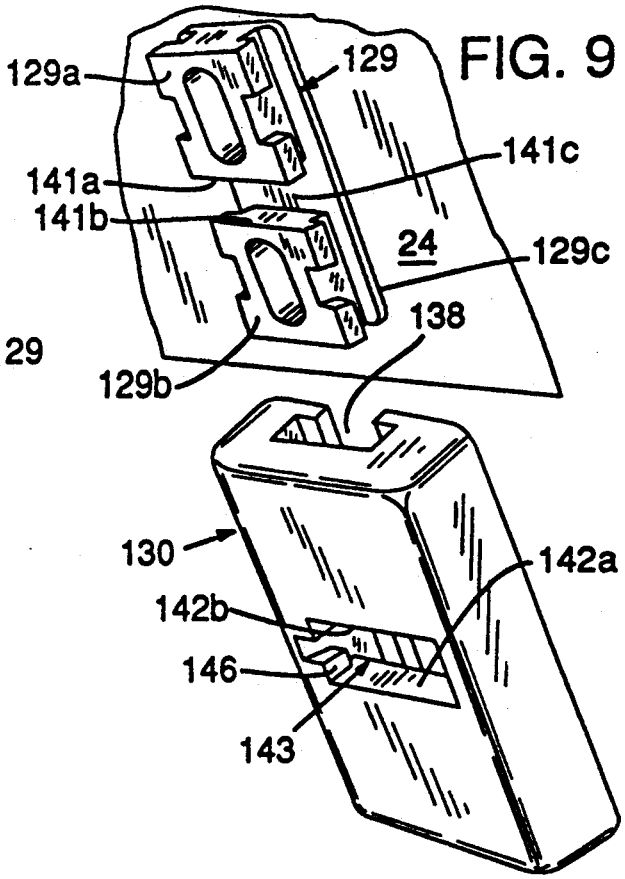
FIG. 9 is an exploded perspective view of another embodiment of the invention which is generally similar to that of FIGS. 2–8 in that T-shaped tongues and grooves are employed but in this embodiment, the lock is positioned intermediate the length of the T-shaped base part.
Figure 10:
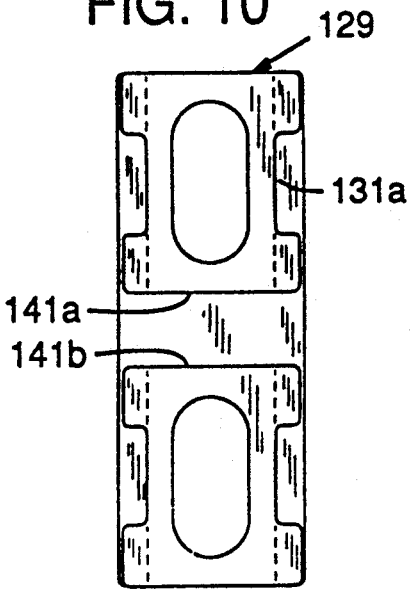
FIG. 10 is a bottom plan view of the base part portion of FIG. 9.
Figure 11:
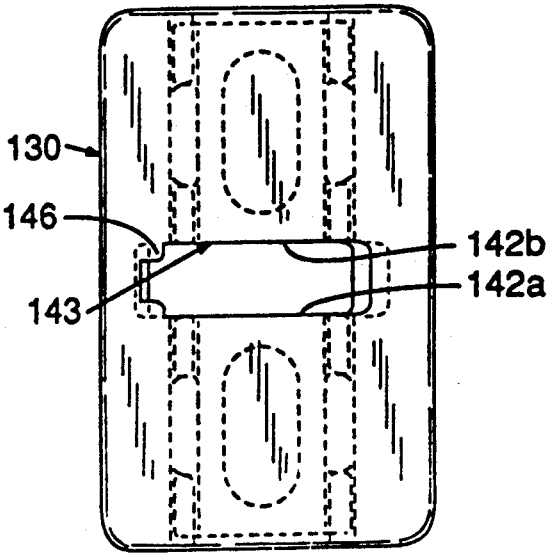
FIG. 11 is a bottom plan view of the assembled parts and showing the lock intermediate the ends of the T-shaped tongue.

This embodiment illustrates the groove means extending the entire length of the part in which it is located. As will be brought out in connection with the next to be described embodiment of FIGS. 12–17, the groove means can be located in the base part as well as the wear part. However, in FIGS. 9–11, we illustrate a wear part having a groove means extending from one end to the other and, in this instance, the tongue means is separated into two longitudinally spaced portions so as to position the lock between these two portions (compare FIGS. 9 and 11). In the embodiment of FIGS. 9–11, like numerals are used for like parts as those employed in connection with the embodiment of FIGS. 1–8 but in this further embodiment, these numerals have been increased by 100.

In FIG. 9 and in the upper portion thereof, it will be seen that a base part generally designated 129 is mounted on a continuous surface 24. The base part 129 is seen to include two discrete, longitudinally separated portions 129*a* and 129*b*. As illustrated, these are connected as at 129*c* but it is also within the purview of the invention to attach the portions 129*a*, 129*b* directly to the continuous surface 24, as by welding. In view of the fact that the portions 129*a*, 129*b* of the base part 129 are substantially like the base part 29 previously described, it is not believed necessary to repeat all of the details nor apply all of the reference numerals. We therefore make reference only to those parts helpful to an understanding of the operation of this embodiment.

For example, the walls on the base part 129 that engage the lock are designated 141*a* and 141*b* (see the upper portion of FIG. 9). The lock employed is identical to that designated 40 in FIG. 7 and is inserted into the opening 143 of the wear part 130. As in the embodiment of FIGS. 2–8, the wear part 130 is equipped with groove means 138 and again the T-shape of the base part constitutes the tongue means.

In this embodiment, the opening 143 provided in the wear part 130 is centrally, longitudinally located so as to coincide generally with the space 141*c* between the portions 129*a*, 129*b* of the wear part 129. The opening 143 has walls 142*a*, 142*b* which cooperate respectively with walls 141*a* and 141*b* of the base part 129 in confronting the lock. In other respects, the embodiment of FIGS. 9–11 is constructed and functions generally in the same fashion as the embodiment of FIGS. 2–8. For example, the wear part is equipped with a keeper 146 and the base part 129 is equipped with notches 131*a*.

EMBODIMENT OF FIGS. 12–17

In this embodiment, again, the T-shape of the tongue and groove means is employed—but here, the tongue 239 is provided on the wear part 230 while the groove 238 is provided on the base part generally designated 229—see especially FIGS. 13 and 15. That constitutes the principal change from the previously described embodiments and only those structural elements which are associated with this change will be described hereinafter—it being understood that in the other respects, the operation of this embodiment parallels that of the previous two embodiments. Again, the base part 229 is secured (as by welding) to the bucket bottom continuous face 24.

Referring now to FIG. 17, it will be seen that the wear part 230 is equipped with tongue means 239 which are provided in longitudinally spaced apart portions in the nature of outstanding bosses 239*a* and 239*b*. These portions are equipped with opposed walls as at 242*a* and 242*b*—see also FIG. 16. These opposed walls 242*a*, 242*b* define a space as at 242*c* which is generally aligned with the lock receiving opening generally designated 243. The lock 240 is of the type described in conjunction with respect to the first embodiment, i.e., FIGS. 2–8, as can be appreciated from FIG. 12.

Again referring to FIG. 17, the base part 229 which is secured to the face 24 (see also FIG. 13) now is equipped with groove means 238. As previously described, the groove means 238 are equipped with transversely spaced longitudinally extending coupling surfaces 232 which are adapted to confront and coact with transversely spaced, longitudinally extending surfaces 231 on the tongue means 239 (compare FIGS. 13 and 15).

As in the embodiment of FIGS. 9–11, there are cooperating opposed walls 241*a*, 241*b* which cooperate respectively with the transverse walls 242*a*, 242*b* of the tongue means 239 (compare FIGS. 14 and 16). Referring specifically to FIG. 14, the boss-like portions 238*a* and 238*b* constituting the groove means 238 are spaced apart as at 241*c* and thus provide the walls 241*a*, 241*b*.

In operation a lock of the nature described at 40 with respect to the embodiment of FIGS. 2–8 is inserted through the opening 243 and into the space 242*c*. It is then contacting walls 241*a*, 242*a* when a force is applied from the left in FIG. 14, and between the walls 241*b* and 242*b* when the force is applied from the right. Loss of the lock upon force application is avoided again through the use of a keeper as at 246 (see FIG. 12) which is provided in the wear part 230 but as is common with the previously described embodiments, in connection with the groove means 238.

EMBODIMENT OF FIGS. 18–22

Figure 19:
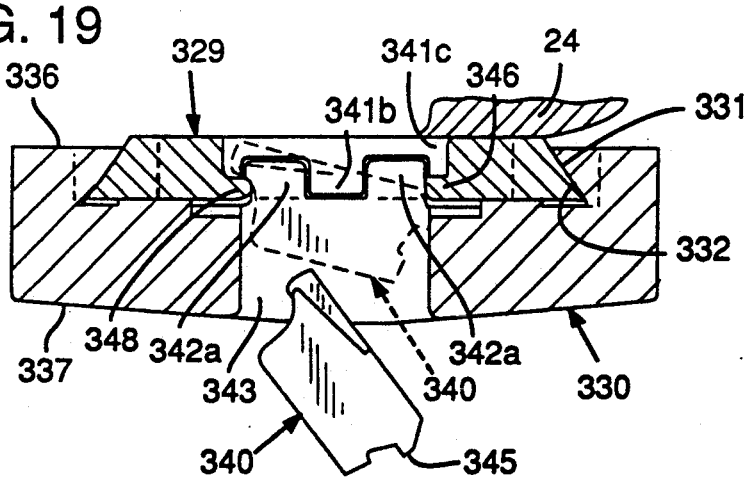
FIG. 19 is a fragmentary transverse sectional view of the parts of FIG. 18 assembled and with the lock in the initial stage of installation.

This embodiment illustrates the use of dovetails for the tongue and groove means. To again facilitate understanding of the structure and operation of this, embodiment, like numerals are used for like or similar elements but in the 300 series. Thus, reference to FIG. 19 shows that the base part generally designated 329 is again secured to the continuous face 24 of the structure to be protected against abrasive wear. The base part 329 again cooperates in this function with a wear part generally designated 330.

The parts 329, 330 are coupled together by means of a dovetail connection which can be readily appreciated from a consideration of FIG. 19. For this purpose, the base element 329 is equipped with a transversely tapered or inclined wall 331 and the wear part or wear runner 330 is equipped with a correspondingly inclined wall 332.

Again, the term "transverse" is used in the prior sense—perpendicular to the longitudinal movement of the parts 329, 330 when being coupled. Again, the longitudinal direction is illustrated by the arrow 333 in FIG. 18.

As before, the wear part 330 can be considered relatively elongated (in the longitudinal direction) and has a first end 334 and a second end 335. In the specific illustration given, the wear part is "reversible", i.e., mountable with either end at a given end of the base part 329. This is described in greater detail in the above mentioned U.S. Pat. No. 5,005,304.

This relatively elongated wear part 330 has first and second outer surfaces. The first surface 336 is adjacent the wearable surface provided by the bottom face 24. This can be readily appreciated from a consideration of FIG. 19. The wear part 330 also has a second outer surface 337 (referring to FIG. 19) and the surface 337 extends generally parallel to the first surface 336. Further, the first surface 336 (see FIG. 18) is generally continuous and extends generally from the first end 334 to the second end 335 of the wear part 330.

Figure 18:
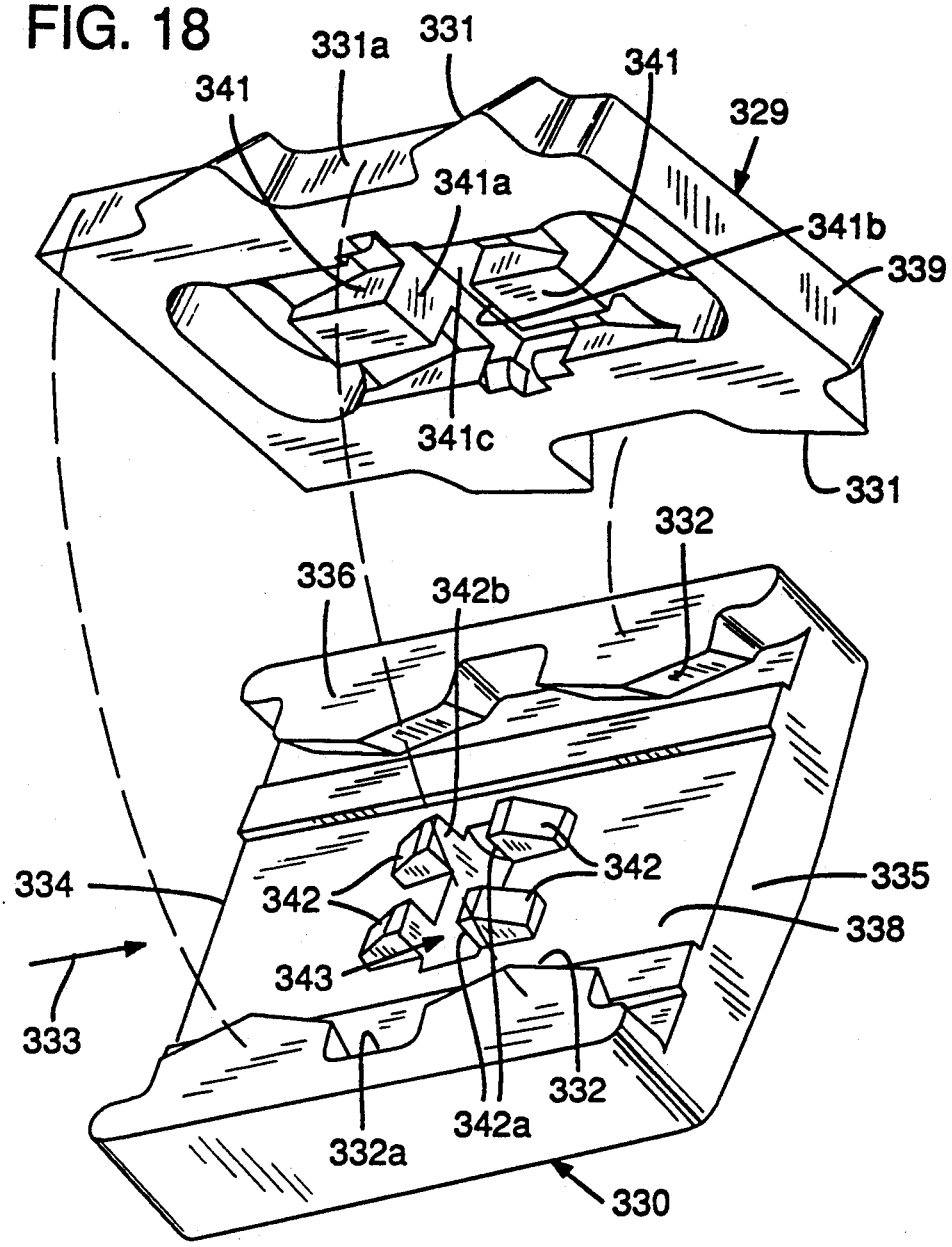
FIG. 18 is an exploded perspective view of the base element and wear part according to another embodiment of the invention.

Referring to FIG. 18, the wear part 330 has a longitudinally extending groove means as at 338 in the first surface 336. Thus, the groove means is defined by or provides the longitudinally extending, transversely spaced apart walls 332 which coact with the walls 331 in the base element 329—so as to releasably couple the base element 329 and wear part 330 together. Thus, the entire base part 329 can be considered the tongue means 339. The groove means 338 in this embodiment extends the full length of the wear part 330.

Again, in the broadest aspect of this embodiment of the invention, the longitudinally extending, transversely spaced apart coupling walls 331, 332 only require mating engagement to prevent the parts from moving apart in a direction perpendicular to the wearable face 24. For example, this is advantageously achieved by the inclined walls of FIG. 19 which have a horizontal component providing the same coupling action as the horizontal walls 31, 32 of the embodiment of FIGS. 2–8.

In this embodiment, we also employ notches as at 331*a* relative to the base part 329 and 332*a* relative to the wear part 330—see FIG. 18.

LOCK OF EMBODIMENT OF FIGS. 18–22

Figure 20:
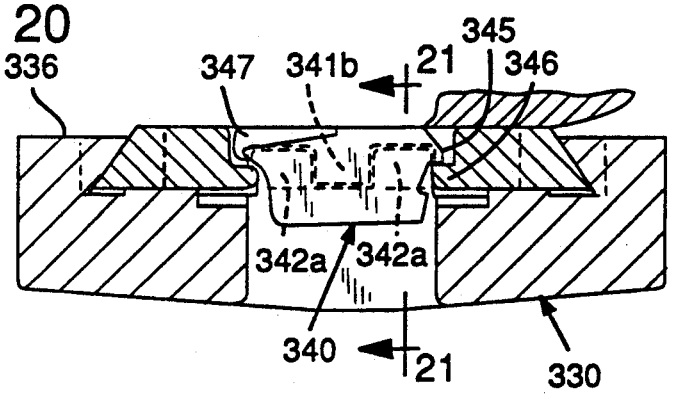
FIG. 20 is a view similar to FIG. 19 but showing the lock fully installed.
Figure 21:
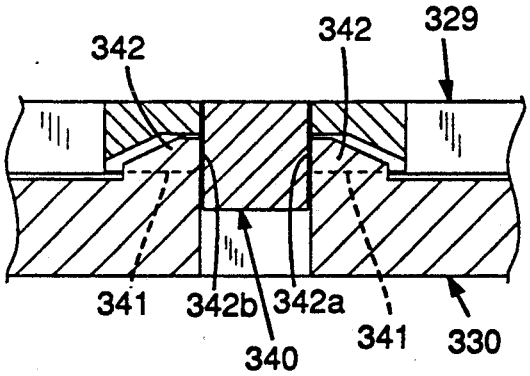
FIG. 21 is a longitudinal sectional view of the assembled parts of FIG. 18 such as would be seen along the sight line 21–21 applied to FIG. 20.

A lock generally designated 340 (see FIGS. 19–20) is provided which also utilizes certain of the teachings of the above-mentioned co-pending U.S. application Ser. No. 07/642,390. Advantageously, the lock is again essentially block-shaped, viz., again a generally rectangular solid, and operates to hold the parts 329, 330 together by being in a compressive mode. This is achieved by virtue of having transverse walls 341*a*, 341*b* provided on the base part 329 (compare FIGS. 18 and 19) and further pairs of transverse walls as at 342*b*, 342*a* on the four bosses or projections 342 associated with the groove means 338 and opening 343 of the wear part 330. Thus, the cooperating walls for bearing against the lock 340 are transversely spaced, transversely-extending wall 342*a* on the wear part 330 and transverse wall 341*a* on the base part 339—the bosses 341 being aligned with the space between walls 342*a* but longitudinally spaced therefrom as can be seen from FIG. 18. In FIG. 20, for example, the base part wall 341*b* is seen positioned between walls 342*a* of the wear part 330.

Again, the lock 340 is inserted through the opening 343 (see FIG. 19) provided in the wear part 330. As can be seen in FIG. 18, the opening 343 is adjacent the bosses 342 which provide one pair of surfaces for compressibly engaging the lock 340. The coacting bearing surface 341*a* or 341*b* is provided by one of the bosses 341 (see FIG. 18)

In the event the dovetails are not convergent, the walls 341*a*, 342*b* or 341*b*, 342*a* serve to apply compressive stress to the lock 340 in both longitudinal directions—assuming this is the direction of major force application, such as the thrust component of an applied load.

It will be noted that the base part 329 has an opening 341*c* extending therethrough (see FIG. 19) and which is generally aligned with the opening 343 in the wear part 330. The opening 341*c* provides the keeper means 346 (see FIG. 19) which engages the latch 345 of the lock 340 (see FIG. 20).

Here the keeper means 346 (corresponding to the keeper means 46 of the first embodiment) is located in the base element 329 (see FIG. 19). The lock 340 has an integral projection 345 that, with the resilient plug 347, performs a function similar to that of elements 45 and 47 of the first embodiment. The plug 347 is advantageously bonded to the basic metal block shape of the lock 340—see FIG. 22. This permits retraction of the latch part 345 so as to pass by the keeper 346 while pivoting around the arcuate projection 348 as shown in FIG. 19.

SUMMARY

From the foregoing, it will be seen that there are a variety of combinations of elements useful in the practice of the invention. For example, the coupling means consisting of the tongue means and groove means may be provided in either part. In the embodiments of (a) FIGS. 2–8, (b) FIGS. 9–11 and (d) FIGS. 18–22, the tongue means 39, 139 and 339 are provided in the base part 29, 129, and 339 respectively. Correspondingly, the groove means, 38, 138 and 338 are provided in the wear part 30, 130 and 330. In the third embodiment (c) FIGS. 12–17, the tongue means 239 are provided in the wear part. Normally when the amount of throw-away metal is a consideration, the groove means would be provided in the replaceable part, i.e., the wear part 30, etc.

Further, or alternatively, the tongue means and groove means may be generally T-shaped or dovetail shaped. In either case there is provided transversely spaced, longitudinally extending surfaces on both of the coupling means that coact to prevent disengagement of the parts—as by preventing movement of the wear part away from the base part in a direction generally perpendicular to the face 24 to be protected. As illustrated, the surfaces of the groove means performing this function are designated 32, 132, 332 and coact with surfaces 31, 131, 231 and 331 of the tongue means.

Again, there is the choice of having these surfaces straight or convergent. In the embodiments of (a) FIGS. 2–8, (b) FIGS. 9–11 and (c) FIGS. 12–17, the surfaces 31, etc. and 32, etc. are longitudinally parallel while in the embodiment of (d) FIGS. 18–22, the surfaces 331, 332 are longitudinally convergent. By tapering the tongue and groove means, restraint of the wear part 330 from moving on the base part 329 has to be provided in only one direction—because the convergence prevents movement in the other direction. Nonetheless, we make constraints available in both directions in the embodiment (d) of FIGS. 18–22 in order to provide reversibility of the wear part.

Still further, the invention contemplates either straight or notched tongue and groove means as by having the notches 31*a*, etc., 32*a*, etc. present or not. The presence of these notches makes possible the coupling of the parts with limited longitudinal movement of the wear part relative to base part.

Figure 22:
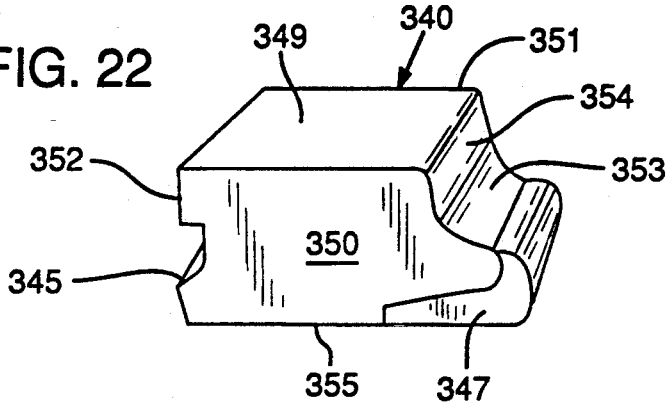
FIG. 22 is a perspective view of the lock featured in FIGS. 19–21.

There is also the choice of locks, viz., the lock 40 which, as illustrated, is used in the embodiments (a), (b) and (c), and the lock 340 illustrated in the fourth embodiment, FIGS. 18–22. In general, the locks 40, 340 differ in the way the latch means 45, 345 are provided. As seen in FIG. 7 relative to the lock 40, a special composite latch member 45 is provided which incorporates a resilient portion 47. As seen in FIG. 22, the lock 340 has an integral latch 345 at one end and a resilient pad 347 at the other end. In either case, the latch 45, 345 engages keeper means 46, 346 by passing by the keeper means. This is effected in both cases by the resiliency of the pad 47, 347. As illustrated the lock 340 is used in conjunction with keeper means on the base part 329. However, the keeper means could equally well be in the wear part. By the same token, the lock 40 is used in conjunction with the keeper means 46 on the wear part 30. However, again, the keeper means could be provided in the base part. The removal of the lock 340 is analogous to the removal of the lock 40 in that a screwdriver or other tool bears against the side of the lock to compress a resilient pad. In the case of the lock 340, the screwdriver bears against the face 352 to compress the pad 347 so as to permit the latch 345 to pass by the keeper means 346. Relative to the lock 340, the screwdriver or other tool compresses the composite latch member 345 to enable it to pass by the keeper 46.

As pointed out previously the lock 40 (see FIG. 7) extends between the transverse wall 41 on the base part 29 and the transverse wall 42 of the opening 43. More particularly, the lock has opposed faces as at 50 and 51 which confront, respectively, the walls 41 and 42. The face 52 which is orthogonally related to the faces 50, 51 is equipped with the latch 45. There is a fourth face 53 which is generally parallel to the face 52 and which has an arcuate portion 54 which cooperates with the arcuate protrusion 48 in pivoting the latch past the keeper 46.

Corresponding structure is found in the embodiment of lock 340 depicted in FIG. 22. There we see faces 350 and 351 which are those confronting the transverse walls 341*a* and 342*a* or 341*b* and 342*b*. Extending orthogonally between the faces 350, 351 is a third face 352 in which is provided the latch 345. The body constituting the lock 340 has a fourth face 353 which again has an arcuate portion 354 for engagement with the protrusion 348.

As seen in FIG. 22, the resilient pad 347 extends in partial covering relation to each of the faces 353 and the sixth face 355. Comparison of FIGS. 19 and 20 reveals how the resilient pad 347 is compressed during the installation of the lock—more particularly the passage of the latch 345 past the keeper 346.

This is to correlate and summarize the elements particularly of the first and fourth embodiments of the inventive lock assembly for a structure having a face 24 subject to abrasive wear.

The face 24 is equipped with relatively elongated base part 29, 329 which outstands from the face 24. As mentioned previously, the invention is intended for use in protecting surfaces which are continuous and of a generally planar or slightly arcuate nature. This is in contrast with the teaching of the parent application where the surface to be protected had an edge such as a bucket lip.

The base part 29, 329 has transversely spaced apart, longitudinally extending walls 31, 331 for engaging corresponding walls 32, 332 of a wear part 30, 330 to releasably couple the base part and wear part together. The base part also has a transverse wall 41, 341*a* for engaging block-shaped lock means 40, 340.

As indicated above, the assembly also includes a relatively elongated wear part 30, 330 removably mounted on the base part 29, 329 and which has first and second ends 34, 334 and 35, 335 and also has a first surface 36, 336 adjacent the structure face 24. The wear part also has a second surface 37, 337 generally parallel to the first surface 36, 336 which is generally continuous, viz., planar or arcuate, and which extends from the first end 34, 334 to the second end 35, 335.

The wear part 30, 330 is equipped with relatively elongated groove means 38, 338 in the first surface 34, 334, the groove means providing the transversely spaced apart, longitudinally extending walls 32, 332 for engaging the longitudinally extending walls 31, 331 of the base part to releasably couple the base part 29, 329 and wear part 30, 330 together. The base part in substantial part provides the tongue means 39, 339 mating with the groove means.

The second surface 37, 337 of the wear part has a generally rectangular opening 43, 343 therein communicating with groove means 38, 338 and the base part. The wear part is equipped with at least one transverse wall 42, 342*a* associated with the opening 43, 343 and extending generally parallel to but spaced from the base part transverse wall 41, 341*a*.

The lock means 40, 340 is mounted in the opening 43, 343 and extends between the base part transverse wall 41, 341*a* and the wear part one transverse wall 42, 342*a*. The lock means 40, 340 is equipped with resilient means such as the plugs 47, 347 and a latch as at 45, 345.

The assembly also has keeper means 46, 346 operably associated with the opening 43, 343. The keeper means 46, 346 extends generally between the base part transverse wall 41, 341*a* and the wear part one transverse wall 42, 342*a* for upsettably confining the lock means 40, 340 against the urging of the resilient means 47, 347.

While in the foregoing specification a detailed description of embodiments of the invention have been set down for the purpose of illustration, many variations in the details hereingiven may be made by those skilled in the art without departing from the spirit and scope of the invention.

We claim:

1. A lock assembly for a structure having a generally continuous face subject to abrasive wear comprising a base part and a wear part, said base part being attached to said face and outstanding therefrom and having a transverse wall for engaging lock means, each of said base part and said wear part having releasable coupling means for coupling said parts together, one of said parts including groove means and the other of said parts including tongue means in engagement with said groove means, each of said tongue means and said groove means being equipped with transversely spaced apart longitudinally extending walls for releasably coupling said parts together, each of said parts having first and second longitudinally extending surfaces with the first surface of said base part being in contact with said face and the second surface of said base part being remote from said face, said wear part having first and second ends with the first surface thereof being adjacent said face, the second surface of said wear part being generally parallel to said wear part first surface and remote from said face, said wear part first surface extending form said first end to said second end, said coupling means of said base part being along said base part second surface and said coupling means of said wear part being along said wear part first surface, said wear part second surface having a generally rectangular opening communicating with said base part when said parts are in assembled relation, said wear part being equipped with at least one transverse wall extending generally parallel to but spaced from said base part transverse wall, lock means mounted in said opening and extending between said base part transverse wall and said wear part transverse wall, said lock means being equipped with a resilient means and a latch, said latch being resiliently movable in a transverse direction for latching and releasing said lock means in and from said opening, and one of said base part and said wear part including keeper means extending generally longitudinally for upsettably confining said lock means against the urging of said resilient means.

2. The lock assembly of claim 1 in which said longitudinally extending walls in said base part and said wear part are transversely angled to provide dovetail surfaces.

3. The lock assembly of claim 2 in which portions of each said longitudinally extending wall in said base part and in said wear part converges with said spaced apart longitudinally extending wall of the same part.

4. The lock assembly of claim 3 in which each of said parts have opposed notches associated with said longitudinally extending walls.

5. The lock assembly of claim 1 in which each of said tongue means and groove means have a generally T-shape in transverse section.

6. The lock assembly of claim 5 in which said longitudinally extending walls in each of said base part and said part have first and second ends, each of said walls being interrupted intermediate the ends of said walls to provide opposed notches.

7. The lock assembly of claim 5 in which all of said longitudinally extending walls are longitudinally parallel.

8. The lock assembly of claim 7 in which said longitudinally extending walls in each of said base part and said wear part have first and second ends, each of said walls being interrupted intermediate the ends of said walls to provide opposed notches.

9. The lock assembly of claim 1 in which said base part is equipped with an opening aligned with said wear part opening and said keeper means is provided in said base part opening.

10. The lock assembly of claim 1 in which said wear part opening is equipped with said keeper means.

11. A lock assembly for a structure having a generally continuous face subject to abrasive wear comprising a relatively elongated base part and a relatively elongated wear part, said base part being attached to said face and outstanding therefrom and having a transverse wall for engaging lock means, means releasably coupling said parts together including tongue means on one part in engagement with groove means on the other part, each of said tongue means and said groove means being equipped with transversely spaced apart longitudinally extending walls for releasably coupling said parts together, each of said parts having first and second longitudinally extending surfaces with the first surface of said base part being in contact with said face and the second surface of said base part being remote from said face, said wear part having first and second ends with the first surface thereof being adjacent said face, the second surface of said wear part being generally parallel to said wear part first surface and remote from said face, said wear part first surface being generally continuous and extending from said first end to said second end, one of said coupling means being along said base part second surface and the other of said coupling means being along said wear part first surface, said wear part second surface having a generally rectangular opening communicating with said base part when said parts are in assembled relation, said wear part being equipped with at least one transverse wall extending generally parallel to but spaced from said base part transverse wall, lock means mounted in said opening and extending between said base part transverse wall and said wear part transverse wall, said lock means being equipped with resilient means, said lock means including a block-shaped metal body having a pair of opposed faces engaging said base part transverse wall and said wear part transverse wall, said body having a third face orthogonally related to said pair of faces and equipped with latch means for engaging keeper means, and one of said base part and said wear part including keeper means extending generally longitudinally for upsettably confining said lock means against the urging of said resilient means.

12. The lock assembly of claim 11 in which said latch means is secured to said resilient means for movably mounting said latch means in said body.

13. The lock assembly of claim 11 in which said latch means is integral with said body and said resilient means includes a resilient pad element attached to said body and spaced oppositely of said latch means.

14. The lock assembly of claim 13 in which said body has a fourth face generally parallel with the said third face and a fifth face connecting said third and fourth faces, said resilient pad element covering a portion of each of said fourth and fifth faces.

15. A lock assembly for a structure having a generally continuous face subject to abrasive wear comprising a relatively elongated base part and a relatively elongated wear part, said base part being attached to said face and outstanding therefrom and having a transverse wall for engaging lock means, means releasably coupling said parts together including tongue means on one part in engagement with groove means on the other part, each of said tongue means and said groove means being equipped with transversely spaced apart longitudinally extending walls for releasably coupling said parts together, each of said parts having first and second longitudinally extending surfaces with the first surface of said base part being in contact with said face and the second surface of said base part being remote from said face, said wear part having first and second ends with the first surface thereof being adjacent said face, the second surface of said wear part being generally parallel to said wear part first surface and remote from said face, said wear part first surface being generally continuous and extending from said first end to said second end, one of said coupling means being along said base part second surface and the other of said coupling means being along said wear part first surface, said wear part second surface having a generally rectangular opening communicating with said base part when said parts are in assembled relation, said wear part being equipped with at least one transverse wall extending generally parallel to but spaced from said base part transverse wall, one of said parts being equipped with spaced apart boss-like projections each equipped with a portion of the transverse wall associated with said one part, the other of said parts being equipped with a boss-like projection aligned with the space between said one part boss-like projections, said other part boss-like projection being equipped with the transverse wall associated with said other part, lock means mounted in said opening and extending between said base part transverse wall and said wear part transverse wall, said lock means being equipped with resilient means, and one of said base part and said wear part including keeper means extending generally longitudinally for upsettably confining said lock means against the urging of said resilient means.

16. The lock assembly of claim 15 in which said one part is said base part and said other part is said wear part.

17. The lock assembly of claim 16 in which said tongue and groove means is T-shaped.

18. The lock assembly of claim 15 in which said one part is said wear part and said other part is said base part.

19. The lock assembly of claim 18 in which said tongue and groove means includes longitudinally convergent dovetails.

20. A lock assembly for a wearable structure having a generally planar face subject to abrasive wear, said lock assembly comprising a base part mounted on said face, a wear part mounted on said base part, and a lock, said parts including a tongue and groove coupling structure extending generally in a first direction to couple said parts together to prevent movement of said wear part away from said base part in a second direction generally perpendicular to said face, each part having a locking wall extending in said second direction and in a third direction transverse to said first direction, said locking walls being parallel to each other and spaced apart, one of said parts including a keeper extending generally in said first direction, and said lock being mounted between said locking walls and equipped with a latch and a resilient element enabling resilient movement of said latch in said third direction to permit passage of said latch past said keeper to releasably retain said lock between said locking walls.

21. A lock assembly for a structure having a generally planar face subject to abrasive wear, said face being equipped with a base part outstanding from said face, said base part having transversely spaced apart longitudinally extending walls and at least one transverse wall, a wear part having spaced apart longitudinally extending walls for engaging said longitudinal walls of said base part to releasably couple said base part and said wear part together, first and second ends, a first surface adjacent said face of said structure and a second surface generally parallel to said first surface and remote from said structure face, said first surface being generally planar and extending from said first end to said second end, said second surface having a generally rectangular opening therein communicating with said base part, said wear part being equipped with at least one transverse wall associated with said opening and extending generally parallel to but spaced from said base part transverse wall, a lock mounted in said opening and extending between said base part transverse wall and said one transverse wall of said wear part to substantially prevent longitudinal movement of said wear part relative to said base part, said lock being equipped with a resilient element permitting transverse movement of at least a portion of said lock, and one of said parts further including a keeper proximate said opening, said keeper extending generally longitudinally for upsettably confining said lock against the urging of said resilient element.

22. The lock assembly of claim 21 in which each of said parts is equipped with two longitudinally spaced transverse walls.

23. The lock assembly of claim 21 in which said transverse wall of each of said parts is provided by an integral boss.

24. A wear part for protecting a face of a working structure subjected to abrasive wear, said wear part comprising a pair of longitudinal sides, a pair of ends, a first surface adapted for opposing the working structure face, a second surface adapted to be remote from the working structure face to provide a wear surface, a generally T-shaped coupling structure formed with said first surface and extending longitudinally between said sides, said T-shaped coupling structure being adapted to cooperate with a base part integrally fixed to the working structure face and prevent movement of said wear part away from the working structure face, and a generally rectangular opening for receiving a lock to substantially prevent longitudinal movement of the wear part relative to the base part, said opening being defined in and extending through said second surface so that said opening communicates with said T-shaped coupling structure, said opening including a pair of sidewalls generally parallel to said wear part ends to engage with the lock and prevent longitudinal movement of said wear part and a pair of end walls generally parallel to said wear part sides, one of said opening end walls including a keeper adapted to retain a lock, said keeper including a tab extending into said opening and being spaced from said T-shaped coupling structure.

25. The work part of claim 24 in which said coupling structure includes a generally T-shaped slot opening in said first surface and extending from end to end between said sides, said T-shaped slot adapted to cooperate with a T-shaped structure of the base part and prevent movement of said wear part away from the working structure face.

26. The wear part of claim 25 in which said T-shaped slot opens in one of said ends and is closed at the other of said ends.

27. The wear part of claim 25 in which said first surface further includes at least one recess adjacent to and communicating with each side of said T-shaped slot to define spaced ears for coupling with spaced ears of the T-shaped structure of the base part to secure said wear part against movement away from the working structure face.

28. The wear part of claim 24 in which the other opening end wall includes a protrusion adapted to function as a fulcrum for the lock, said protrusion being opposed to said keeper and spaced from said T-shaped coupling structure.

29. The wear part of claim 24 in which said keeper includes an access space in said tab for permitting insertion of a tool past said keeper to release the lock from said opening.

30. The wear part of claim 24 in which said coupling structure includes a pair of T-shaped retaining projections adapted to cooperate with a T-shaped slot in the base part fixed to the working structure face to prevent movement of said wear part away from the working structure face, wherein said retaining projections each has at least one end which is aligned with one of said opening sidewalls to engage against the lock received in said opening and thereby substantially prevent longitudinal movement of said wear part.

* * * * *